United States Patent [19]

Nishikawa et al.

[11] Patent Number: 4,787,357

[45] Date of Patent: Nov. 29, 1988

[54] INTAKE SYSTEM FOR AN INTERNAL COMBUSTION ENGINE

[75] Inventors: Toshio Nishikawa; Makoto Hotate, both of Hiroshima; Tadataka Nakazumi, Kure; Tadashi Kaneko, Hiroshima, all of Japan

[73] Assignee: Mazda Motor Corporation, Hiroshima, Japan

[21] Appl. No.: 923,865

[22] Filed: Oct. 28, 1986

[30] Foreign Application Priority Data

Oct. 30, 1985 [JP] Japan ..... 60-243108

[51] Int. Cl.[4] ..... F02D 41/06; F02D 41/14

[52] U.S. Cl. ..... 123/489; 123/491

[58] Field of Search ..... 123/489, 440, 491

[56] References Cited

U.S. PATENT DOCUMENTS

| | | | |
|---|---|---|---|
| 4,321,903 | 3/1982 | Kondo | 123/489 |
| 4,357,922 | 11/1982 | Rosenzopf | 123/489 |
| 4,483,301 | 11/1984 | Yamada | 123/489 |
| 4,566,419 | 1/1986 | Ninomiya | 123/489 |
| 4,580,539 | 4/1986 | Kitahara | 123/440 |
| 4,628,883 | 12/1986 | Kataoka | 123/491 X |

FOREIGN PATENT DOCUMENTS

| | | | |
|---|---|---|---|
| 203844 | 12/1982 | Japan | 123/440 |
| 27847 | 2/1983 | Japan | 123/440 |
| 208141 | 11/1984 | Japan | 123/440 |

*Primary Examiner*—Tony M. Argenbright

*Attorney, Agent, or Firm*—Fleit, Jacobson, Cohn & Price

[57] ABSTRACT

An intake system utilizing an air-fuel control which is changed in accordance with the coolant temperature. When the coolant temperature is lower than the first coolant temperature, an open loop control is carried out in accordance with the coolant temperature so that a fluctuation of the air-fuel ratio can be restricted so as to obtain a stability. An air-fuel feedback control is carried out between the first and second coolant temperatures wherein the air-fuel ratio is maintained at the stoichiometric value so that an increase of $NO_X$ emitted from the engine can be suppressed. In the region in which the coolant temperature exceeds the second temperature, an air-fuel feedback control is carried out in the lean mixture side of the stoichiometric value in accordance with the coolant temperature to thereby improve the emission performance of the engine.

6 Claims, 7 Drawing Sheets

INTAKE SYSTEM FOR AN INTERNAL COMBUSTION ENGINE

BACKGROUND OF THE INVENTION

Field of the invention

The present invention relates to an engine intake system and more particularly to an air-fuel ratio control for an engine wherein the air-fuel ratio is controlled to a desirable value in accordance with outputs of a sensor which detects components of exhaust gas.

Description of Prior Art

There is known an intake system for an internal combustion engine in which an $O_2$ sensor detects a change of oxygen concentration in exhaust gas so that the air-fuel ratio is controlled based on the output of the sensor.

For example, Japanese Patent Public Disclosure No. 59-208141 filed on May 12, 1983 and diclosed for public inspection on Nov. 26, 1984, discloses a method of controlling lean air-fuel ratio in electronic control engine in which the air-fuel ratio is controlled to the leaner side than the theoretical air-fuel ratio in response to the output of a lean sensor for generating a signal proportional to oxygen concentration in exhaust gas by means of a feedback control. In Japanese Public Disclosure No. 57-203844 filed on June 10, 1981 and diclosed on Dec. 14, 1982 for public inspection, there is disclosed an engine air-fuel ratio control system wherein an air-fuel feedback control system is effected to obtain a desirable air-fuel ratio by employing a linear $O_2$ sensor which produces outputs proportional to the oxygen concentration in the exhaust gas. Further in the Japanese Patent Public Disclosure No. 58-27847 filed on Aug. 13, 1981 and disclosed on Feb. 18, 1983 for public inspection, there is disclosed a feedback control system for the air-fuel ratio control in which the feedback control is carried out even in the warming-up condition of the engine.

In the system disclosed in the Japanese Patent Public Disclosure No. 59-208141, there is provided a map by which a base injection pulse width is obtained based on the engine speed and intake gas pressure in the intake passage. A desirable air-fuel ratio corresponding to an engine operating condition is determined in accordance with the base injection pulse width. The base fuel injection pulse is revised in response to the output of the $O_2$ sensor so as to control the air-fuel ratio to the desirable value so that a final fuel injection pulse width corresponding to the amount of an actual fuel injection can be obtained. In this system, a temperature of the coolant of the engine is detected to compensate the fuel injection pulse width in accordance with the coolant temperature wherein the amount of fuel injection is increased under a warming-up condition. the increase of the fuel injection in the warming-up condition is continuously reduced in accordance with a gradual increase of the cooling water temperature from start-up to normal operation of the engine. It will therefore be understood that the air-fuel ratio is continuously changed from a rich mixture to lean mixture in accordance with the increase of the coolant temperature. According to this control, it is advantageous in the fact that there is no abrupt change in the air-fuel ratio so that a stable lean feedback control for the air-fuel ratio can be obtained to provide a proper drivability.

It should however be noted that there is a certain region of the air-fuel ratio which provides such engine operating condition that the amount of $NO_x$ in the exhaust gas is maximized causing an emission property of the engine to deteriorate, while the engine operating condition changes from the warming-up to normal operating condition. There occurs another problem in the system that the air-fuel feedback control produces a fluctuation in the air-fuel ratio in the vicinity of the desirable air-fuel ratio to harm the warming-up performance since the engine combustion is unstable under the warming-up condtition.

SUMMARY OF THE INVENTION

It is therefore an object of the present invention to provide an intake system for an internal combustion engine which can suppress a deterioration of the emission performance of the exhaust gas even in the warming-up condition.

It is another object of the present invention to provide an air-fuel control system provided in an intake system in which an improved warming-up performance can be obtained.

The present invention is characterized in the fact that the air-fuel ratio is maintained at the stoichiometric or theoretical air-fuel ratio irrespective of the engine temperature in a predetermined region of the coolant temperature where the emission performance is deteriorated in the warming-up condition. In other words, the air-fuel ratio is kept richer than a value obtained by the air-fuel ratio feedback control in accordance with the coolant temperature.

The above and other objects of the present invention can be accomplished by an intake system for an internal combustion engine including operating condition detecting means for detecting engine operating condition, air-fuel setting means for setting a desirable air-fuel ratio which takes a value in the lean side more than the stoichiometric air-fuel ratio in at least a predetermined engine operating region, coolant temperature detecting means for detecting coolant temperature for engine, warming-up compensating means for compensating said desirable air-fuel ratio in accordance with the outputs of the coolant temperature detecting means in such a manner that the desirable air-fuel ratio moves to the rich side more than the stoichiometric air-fuel ratio as the coolant temperature is decreased, the warming-up compensating means being adapted to provide the desirable air-fuel ratio with the stoichometric value in a predetermined region of the coolant temperature in which the amount of $NO_X$ emitted from the engine is increased and to compensate the desirable air-fuel ratio in accordance with the coolant temperature in the other region of the coolant temperature.

The region of the coolant temperature in which the amount of $NO_X$ emitted from the engine is increased may correspond to such a region of the desirable air-fuel ratio compensated for the warming-up condition that the amount of $NO_X$ is increased more than that in the stoichiometric air-fuel ratio.

In a preferred embodiment, an air-fuel ratio feed back control is carried out so as to control the air-fuel ratio to the stoichiometric air-fuel ratio between a first coolant temperature wherein the desirable air-fuel ratio compensated for the warming-up condition is equivalent to the stoichiometric air-fuel ratio and a second coolant temperature wherein the emission of $NO_X$ under the air-fuel ratio compensated for the warming-up condition is substantially the same value as that under the stoichiometric air-fuel ratio. An open loop control is carried out in the region of the coolant temperature lower than the first coolant temperature in which the air-fuel ratio is controlled to the stoichiometric air-fuel ratio. In the region of the coolant temperature more than the second coolant temprerature, an air-fuel feedback control is carried out wherein the air-fuel ratio is controlled to a desirable air-fuel ratio compensated in accordance with the coolant temperature in the lean mixture side of the stoichiometric value.

A linear sensor which produces outputs proportional to the concentration of components in the exaust gas may be employed for detecting the components of the exaust gas.

The compensating means memorizes the values of the desirable air-fuel ratios compensated for the warming-up condition as a function of the coolant temperature.

According to the present invention , the air-fuel control is changed in accordance with the coolant temperature. In the early time of the warming-up condition in which the coolant temperature is lower than the first coolant temperature, an open loop control is carried out in accordance with the coolant temperature so that a fluctuation of the air-fuel ratio can be restricted so as to obtain a stability in the combustion which provides an appropriate warmning-up performance. The amount of $NO_X$ emitted from the engine is maximized in the vicinity of air-fuel ratio of 16 in the lean mixture side of the stoichiometric air-fuel ratio. According to the present invention, an air-fuel feedback control is carried out between the first and second coolant temperatures wherein the air-fuel ratio is maintained at the stoichiometric value irrespective of the change ofthe coolant temprerature so that an increase of $NO_X$ emitted from the engine can be suppressed. It will be further understood that the desirable air-fuel ratio obtained by the feedback control based on the coolant temperature between the first and second temperature would be in the lean mixture side of stoichiometric air-fuel ratio and therefore the control in accordance with the present invention in which the air-fuel ratio is fixed at the stoichiometric value is effected to obtain an good warming-up performance. In the region in which the coolant temperature exceeds the second temperature, an air-fuel feedback control is carried out in the lean mixture side of the stoichiometric value in accordance with the coolant temperature to thereby improve the emission performance of the engine.

The above and other objects and features of the present invention will be apparent from the following descriptions of a preferred embodiment taking reference to the accompanying drawings.

DESCRIPTION OF THE PREFERRED EMBODIMENT

Figure 1:
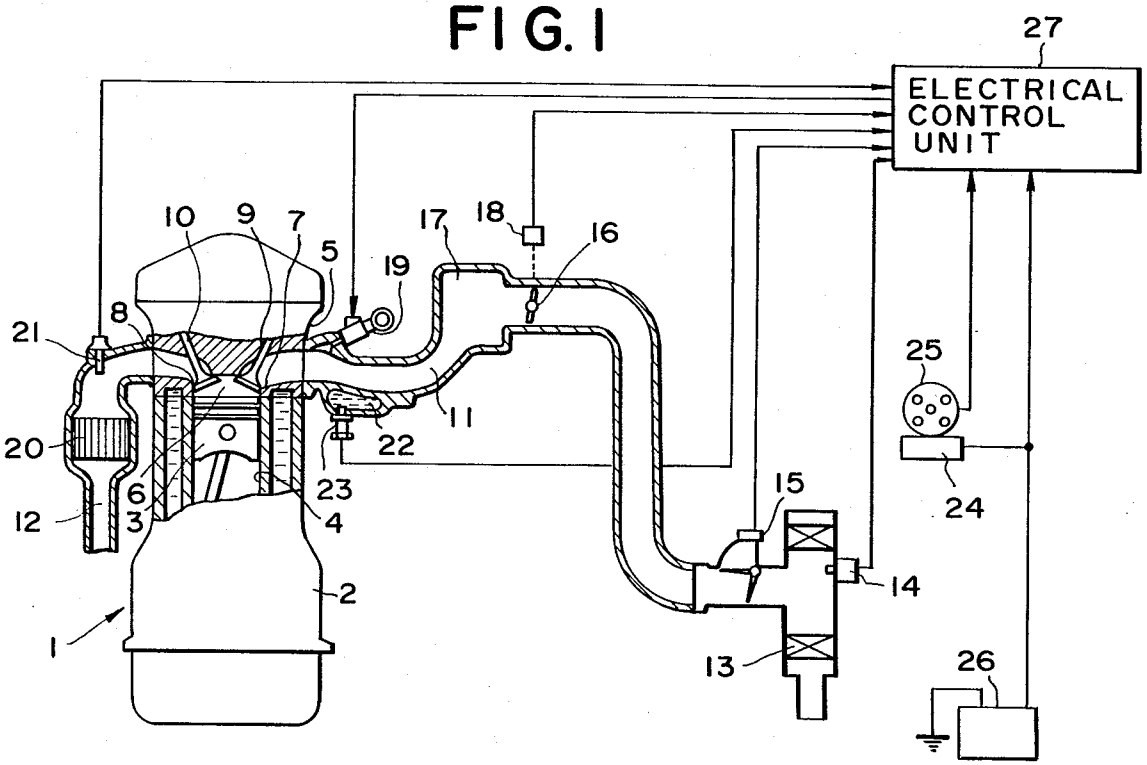
FIG. 1 is a sectional view of an engine having a control system in accordance with the present invention.

Referring now to the drawings, particularly to FIG. 1, there is shown an engine 1 including a cylinder block 2 having a cylinder bore 4 in which a piston 3 is disposed for reciprocating movements. A cylinder head 5 is attached to the cylinder block 2. A recess formed at the lower portion of the cylinder head 5 and an upper space of the cylinder bore 4 defines a combustion chamber 6. The cylinder head 5 is formed with an intake port 7 and an exhaust port 8. An intake valve 9 and exhaust valve 10 are provided in the intake port 7 and exhaust port 8 respectively to open the ports at appropriate timings. The engine 1 is provided with an intake passage 11 communicated with the intake port 7 and an exhaust passage 12. The intake passage 11 has an air cleaner 13 at the upstream end on which a sensor 14 is mounted for detecting the intake gas temperature. There is provided an air flow meter 15 downstream the air cleaner 13 for detecting the amount of intake air. There is further provided a throttle valve 16 downstream the air flow meter 15 for controlling the intake air and a surge tank 17 formed downstream the throttle valve 16. The throttle valve includes a throttle valve position sensor 18 for detecting the opening position of the throttle valve 16. There is provided a fuel injection valve 19 which injects a fuel into the intake air flow in the vicinity of the intake port 7. The exhaust passage is provided with a catalyst converter 20 for cleaning the exhaust gas. Upstream the catalyst converter 20, there is provide a linear exhaust gas sensor 21 which detects the oxygen concentration in the exhaust gas to produce outputs proportional to the oxygen concentration. The engine is further formed with water jacket 22. In the water jacket 22, a coolant temperature sensor 23 is provided for detecting the coolant or cooling water temperature. The engine is further provided with a distributor 25 which produces signals for an igniter 24 at a predetermined timing and a battery 26 as a electric source. The engine is provided with an electrical control unit 27 that incorporates a microcomputer. The control unit 27 receives signals from the sensor 14 denoting the intake air temperature, signals from the air flow meter 15 denoting the amount of the intake air, signals from the throttle valve position sensor 18, signals from the exhaust gas sensor 21 denoting the oxygen concentration in the exhaust gas, signals from the coolant temperature sensor 23 denoting the coolant temperature of the engine and signals from the distributer 25 corresponding to the engine speed. The control unit 27 calculates a desirable air-fuel ratio in accordance with engine operating condition based on the above signals to provide the injector 19 with a proper fuel injection pulse signal in response to the desirable air-fuel ratio.

Figure 2A:
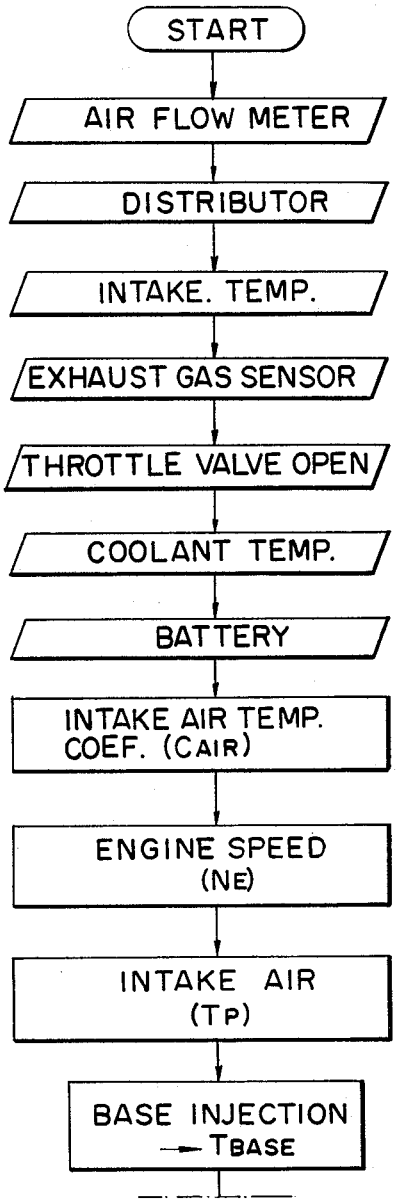
FIGS. 2, 2A and 2B are a program flow chart showing the operation of the control unit.
Figure 2:
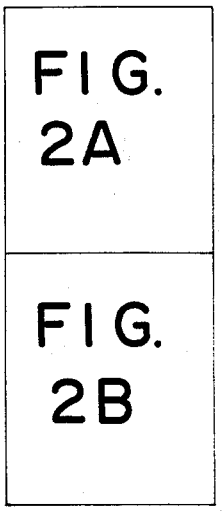
Figure 2B:
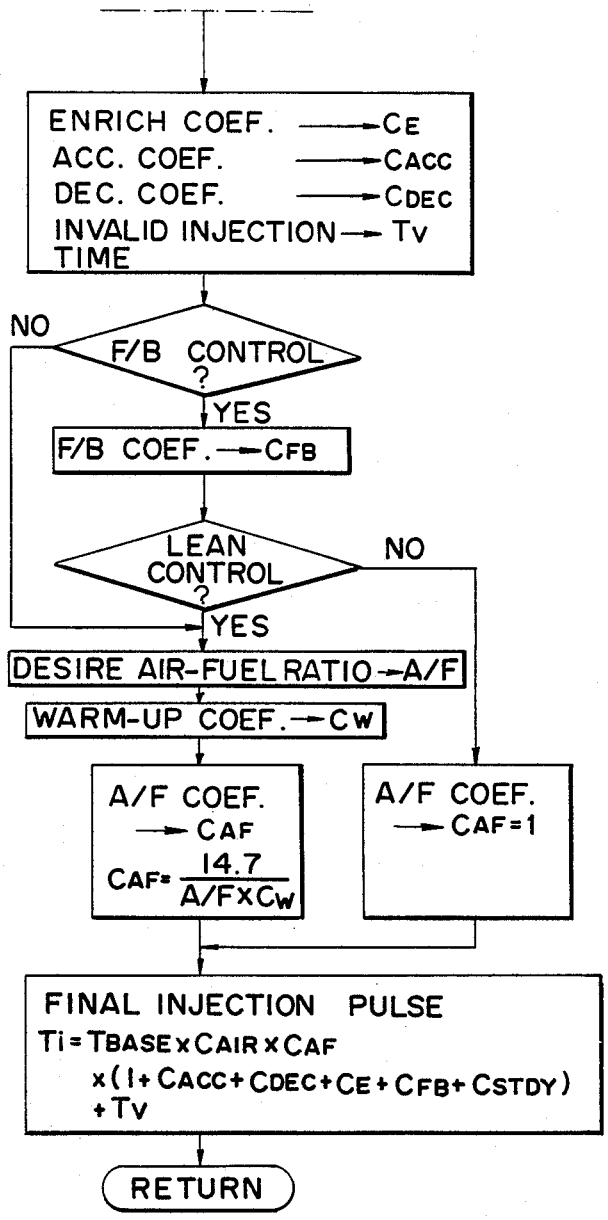
Figure 3:
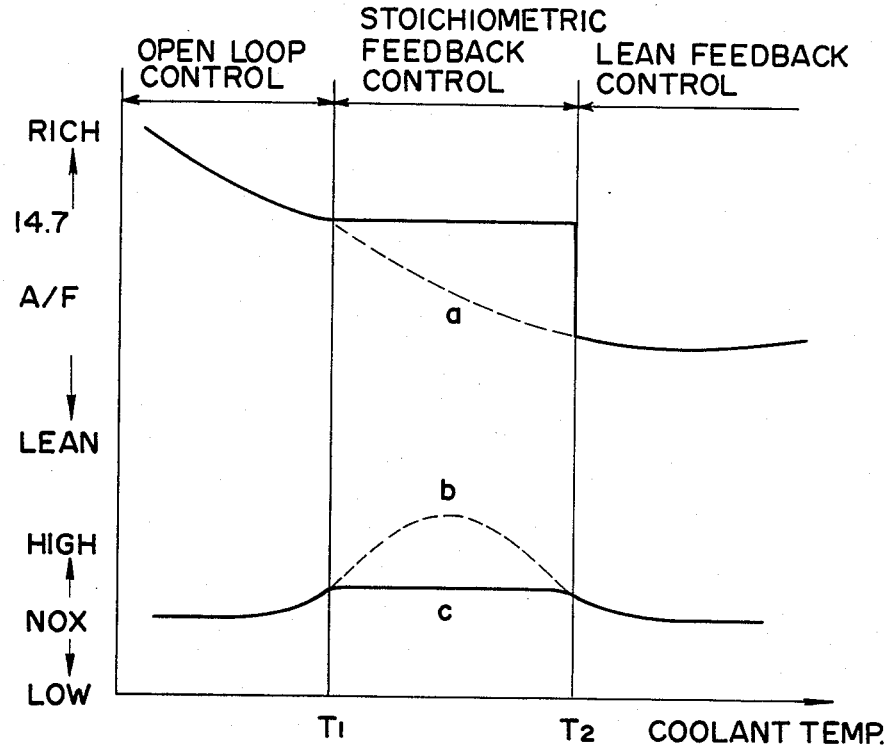
FIG. 3 is a diagram showing an example of changing the air-fuel ratio and emission property of $NO_X$ in relation to the coolant temperature.

Referring to FIG. 2, there is shown a program flow chart of an air-fuel ratio control in accordance with the present invention.

Figure 4:
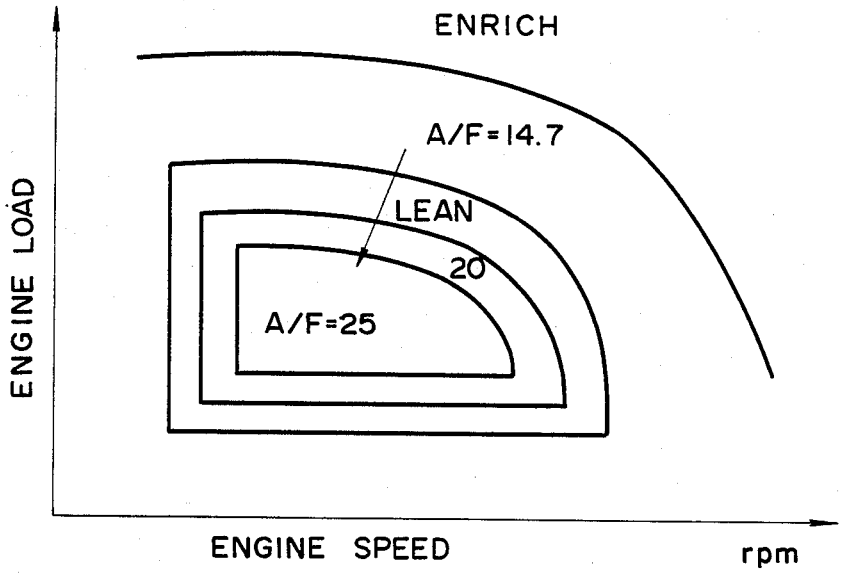
FIG. 4 is a diagram showing an example of changing a coefficient for compensating the air-fuel ratio in accordance with the coolant temperature.

In FIG. 2, the control unit 27 initializes the system and reads signals from the sensors. The control unit 27 in turn compensates the signals from the air flow meter 15 in accordance with the intake air temperature based on the sensor 14 and calculats the amount of intake air $T_P$ per one cycle of the engine. The control unit calculates engine speed $N_e$ based on the signals from the distributer 25. Then the control unit 27 calculates a base fuel injection pulse width $T_{BASE}$ based on the amount of the intake air $T_P$. Further, the control unit 27 calculates various coefficients for compensating the base fuel injection pulse width based on the signals from the aforementioned sensors. In the coeffients, there are included an enrich coefficient $C_E$ for increasing the fuel supply under a heavy load operation of the engine, coefficients $C_{ACC}$ and $C_{DEC}$ for an acceleration and deceleration, and an invalid coefficient $T_V$ for compensating the pulse width in which period the injector 19 injects the fuel invalidly in accordance with a voltage of the battery 26. In the next step, the control unit 27 judges whether or not conditions for the air-fuel feedback control is satisfied. If the judgement is YES, the control unit 27 calculates a feedback compensating coefficient $C_{FB}$ for compensating the fuel injection pulse width in accordance with a difference between the desirable air-fuel ratio and the actual air-fuel ratio on the basis of the outputs of the exhaust gas sensor 19. In this embodiment, the air-fuel control is changed in accordance with the outputs from the coolant temperature sensor 23. When the coolant temperature is lower than a predetermined first cooling water temperature $T_1$, the control unit 27 calculates a desirable air-fuel ratio in accordance with the coolant temperature to carry out an open loop control so that the air-fuel ratio approaches to the desirable air-fuel ratio even when the conditions for the air-fuel feedback control are satisfied. In FIG. 4, there is shown an example of a map of the desirable air-fuel ratio of A/F which can be applied to the present invention. In the illustrated map, the desirable air-fuel ratios are provided by a parameter denoting the engine load, such as throttle valve opening position, and engine speed. Therefore, the control unit 27 calculates the desirable air-fuel ratio in accordance with the engine load detected by means of the throttle valve position sensor 18 and the engine speed $N_e$ obtained by the signals from the distributor 25.

Figure 5:
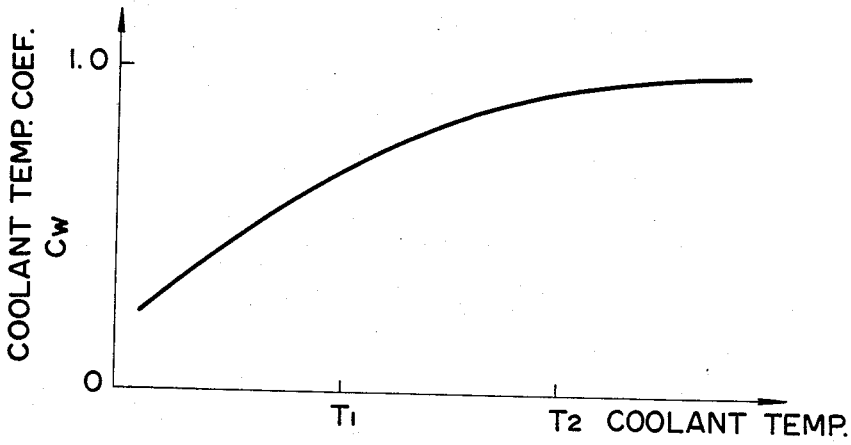
FIG. 5 is a diagram showing an example of an air-fuel ratio control map used for the operation of the control unit.

On the other hand, when the coolant temperature is higher than the first temperature and lower than a second coolant temperature $T_2$ in which the amount of the emission of $NO_X$ is substantially the same as that of the first temperature $T_1$, the control unit 27 provides the desirable air-fuel ratio with the stoichiometric value or $A/F=14.7$, in other words, the control unit 27 fixes an air-fuel compensating coefficient $C_{AF}$ at 1 irrespective of the change of the coolant temperature to carry out an air-fuel feedback so that the air-fuel ratio approaches to the stoichiometric value. When the coolant temperature is increased higher than the second coolant temperature $T_2$, the control unit 27 calculates the air-fuel ratio in accordance with the coolant temperature to carry out an air-fuel feedback control. In the embodiment, the coefficient $C_{AF}$ is provided in accordance with an equation $C_{AF}=14.7/((A/F)*C_W)$ wherein the $C_W$ is a compensating coeffcient which changes in accordance with the coolant temperature as shown in FIG. 5.

As the coolant temperature is increased, the coefficient $C_W$ is increased so that the coefficient $C_{AF}$ is decreased. In this region the desirable air-fuel ratio takes a larger value than the stoichiometric value or $A/F=14.7$ so that the value of the coefficient $C_{AF}$ is smaller than 1 and therefore, the air-fuel ratio control is carried out in the lean side of the stoichiomectric value.

In the embodiment, the first and second coolant temperature are set at 45 through 50° C. and 75 through 80° C. respectively. Finally the control unit 27 calculates the final fuel injection pulse width $T_i$ in accordance with a equation $T_i=T_{BASE}*C_{AIR}*C_{AF}*(1+C_{ACC}+C_{DEC}+C_E+C_{FB})+T_V$.

Figure 6A:
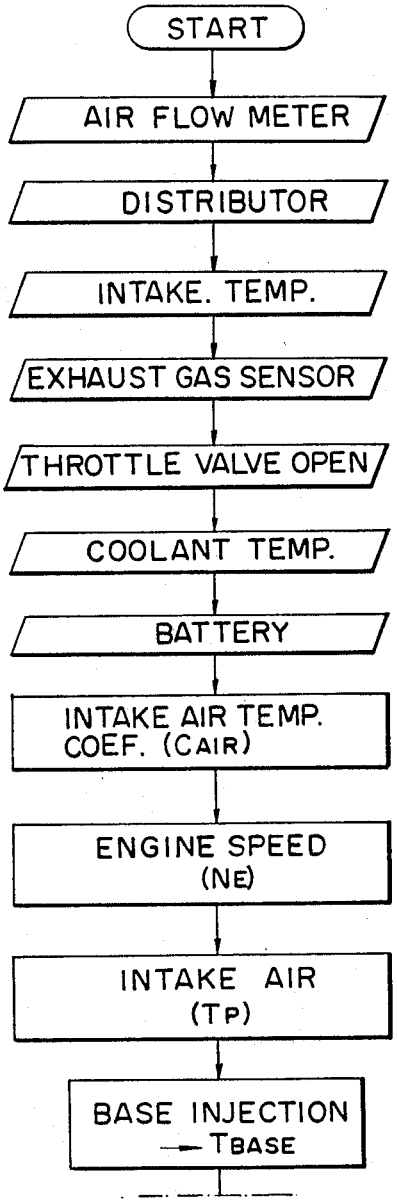
FIGS. 6, 6A and 6B are a program flow chart showing the operation of the control unit in accordance with another embodiment of the present invention.
Figure 6:
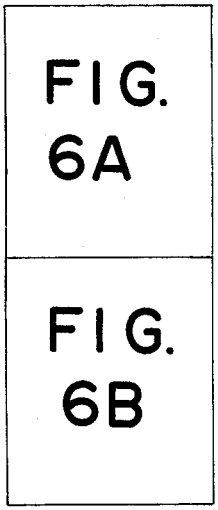
Figure 6B:
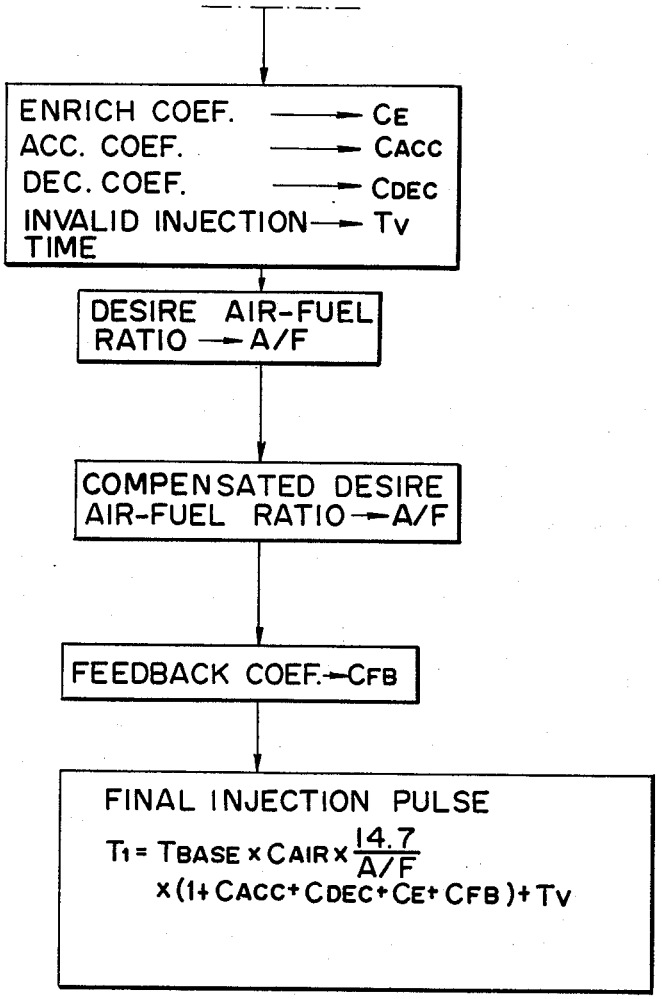

Referring now to FIG. 6, there is shown an example of a program flow chart of the air-fuel control in accordance with another embodiment of the present invention.

Figure 7:
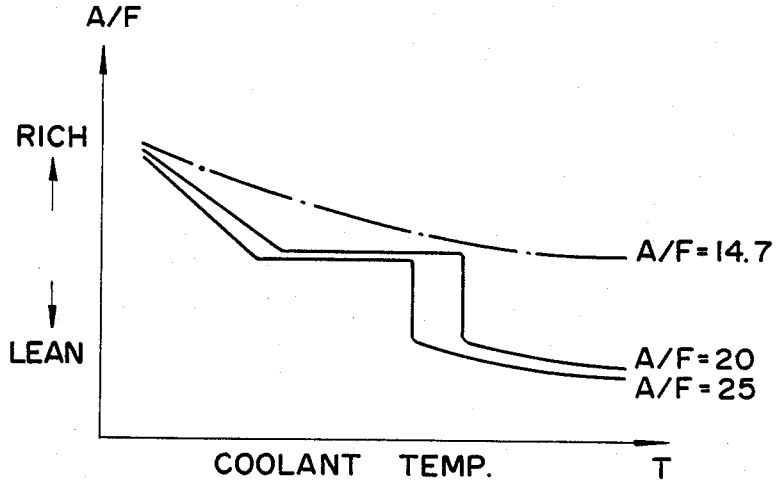
FIG. 7 is a diagram showing a relationship between compensated desirable air-fuel ratio and the coolant temperature.

In this embodiment, the control unit 27 calculates a compensated desirable air-fuel ratio A/F' after calculating the desirable air-fuel ratio A/F based on the map as shown in the FIG. 4 in accordance with the engine operating condition. The compensated desirable A/F' is provided as a function of the desirable air-fuel ratio calculated in accordance with the aforementioned procedure and the coolant temperature as shown in FIG. 7. The value of the A/F' is memorized in a memory in the control unit 27 as a map or table. In the next step, the control unit 27 calculates the coefficient $C_{FB}$ as well as the former embodiment. Finally, the control unit 27 calculates a final fuel injection pulse width $T_i$ in accordance with an equation $T_i=T_{BASE}*C_{AIR}*14.7*(A/F')*(1+C_{ACC}+C_{DEC}+C_E+C_{FB})+T_V$.

The invention has thus been shown and described with reference to a specific embodiment, however, it should be noted that the invention is in no way limited to the details of the illustrated embodiment but changes and modifications may be made without departing from th scope of the appended claims.

What is claimed is:

1. An intake system for an internal combustion engine including operating condition detecting means for detecting an engine operating condition, air-fuel setting means for setting a desirable air-fuel ratio at a value leaner than a stoichiometric air-fuel ratio in at least a predetermined engine operating region after a warming-up condition, coolant temperature detecting means for detecting coolant temperature of the engine, warming-up compensating means for compensating said desirable air-fuel ratio in accordance with the outputs of the coolant temperature detecting means in such a manner that the desirable air-fuel ratio becomes leaner as the coolant temperature is increased, and feedback control means for controlling the air-fuel ratio to correspond with the stoichiometric air-fuel ratio between a first coolant temperature at which the desirable air-fuel ratio, compensated for the warming-up condition, is equivalent to the stoichiometric air-fuel ratio and a second coolant temperature at which the emission of $NO_x$ at the air-fuel ratio compensated for the warming-up condition is substantially the same value as at the stoichiometric air-fuel ratio, an open loop control being carried out in the region of the coolant temperature lower than the first coolant temperature in which the air-fuel ratio is controlled so that it approaches the stoichiometric air-fuel ratio as the coolant temperature approaches said first coolant temperature, and an air-fuel feedback control being carried out so as to control the air-fuel ratio to a desirable air-fuel ratio compensated in the lean mixture side of the stoichiometric value in accordance with the coolant temperature in the region of the coolant temperature more than the second coolant temperature, the warming-up compensating means being adapted to provide the desirable air-fuel ratio with the stoichiometric value between said first coolant temperature and said second coolant temperature where the amount of $NO_x$ emitted from the engine is increased and to compensate the desirable air-fuel ratio in accordance with the coolant temperature in regions other than between said first coolant temperature and said second coolant temperature.

2. An intake system in accordance with claim 1 wherein the emission of $NO_x$ is substantially constant between said first coolant temperature and said second coolant temperature.

3. An intake system in accordance with claim 1 including a linear sensor which produces outputs proportional to the concentration of components in the exaust gas for detecting the components of the exaust gas in said airfuel feedback control.

4. An intake system in accordance with claim 1 in which said compensating means memorizes values of desirable air-fuel ratios, compensated for the warming-up condition, as a function of the coolant temperature wherein the compensated air-fuel ratio is set at the stoichiometric value in a region between first and second coolant temperatures, and set in accordance with the coolant temperature in regions in which the coolant temperature is lower than the first coolant temperature or higher than the second coolant temperature.

5. An intake system for an internal combustion engine including operating condition detecting means for detecting an engine operating condition, air-fuel setting means for setting a desirable air-fuel ratio at a value leaner than a stoichiometric air-fuel ratio in at least a predetermined engine operating region after a warming-up condition, coolant temperature detecting means for detecting coolant temperature of the engine, warming-up compensating means for compensating said desirable air-fuel ratio in accordance with the outputs of the coolant temperature detecting means in such a manner that the desirable air-fuel ratio becomes leaner as the coolant temperature is increased, and feedback control means for controlling the air-fuel ratio to correspond with the stoichiometric air-fuel ratio between a first coolant temperature at which the desirable air-fuel ratio, compensated for the warming-up condition, is equivalent to the stoichiometric air-fuel ratio and a second coolant temperature at which the emission of $NO_x$ at the air-fuel ratio compensated for the warming-up condition is substantially the same value as at the stoichiometric air-fuel ratio, an open loop control means for carrying out an open loop control in the region of the coolant temperature lower than the first coolant temperature in which the air-fuel ratio is controlled so that it approaches the stoichiometric air-fuel ratio as the coolant temperature approaches said first coolant temperature, and an air-fuel feedback control being carried out so as to control the air-fuel ratio to a desirable air-fuel ratio compensated in the lean mixture side of the stoichiometric value in accordance with the coolant temperature in the region of the coolant temperature more than the second coolant temperature.

6. An air-fuel ratio control method for an internal combustion engine including the steps of detecting an engine operating condition, detecting coolant temperature of the engine, compensating a desirable air-fuel ratio in accordance with the outputs of the coolant temperature detecting means in such a manner that the desirable air-fuel ratio becomes leaner as the coolant temperature is increased, providing the desirable air-fuel ratio with the stoichiometric value in a predetermined region of the coolant temperature in which the amount of $NO_x$ emitted from the engine is increased, compensating the desirable air-fuel ratio in accordance with the coolant temperature in regions other than said predetermined region, and setting a desirable air-fuel ratio at a value leaner than a stoichiometric air-fuel ratio in at least a predetermined engine operating region after a warming-up condition.

* * * * *